United States Patent [19]

Manchak, Jr.

[11] Patent Number: 4,809,790

[45] Date of Patent: Mar. 7, 1989

[54] DEVICE FOR SAMPLING SOILS AND RETAINING VOLATILES THEREIN AND METHOD OF USING SAME

[76] Inventor: Frank Manchak, Jr., 11300 S. Norwalk Blvd., Santa Fe Springs, Calif. 90670

[21] Appl. No.: 93,305

[22] Filed: Sep. 4, 1987

[51] Int. Cl.[4] ..... E21B 49/02

[52] U.S. Cl. ..... 175/17; 73/864.44; 175/20; 175/46; 175/58; 175/244

[58] Field of Search ..... 175/20, 21, 17, 58, 175/46, 50, 59, 244; 73/864.74, 864.43, 864.44, 864.45

[56] References Cited

U.S. PATENT DOCUMENTS

| | | | |
|---|---|---|---|
| 2,626,780 | 1/1953 | Ortloff | 175/404 |
| 2,779,195 | 1/1957 | Simon | 175/17 |
| 2,812,160 | 11/1957 | West et al. | 175/17 |
| 2,854,219 | 9/1958 | MacNeil | 175/404 |
| 2,915,285 | 12/1959 | Deily | 175/17 |
| 2,975,849 | 3/1961 | Stuart | 175/333 |
| 3,055,443 | 9/1962 | Edwards | 175/333 X |
| 3,416,374 | 12/1968 | Smith | 73/864.43 |
| 3,443,650 | 5/1969 | Gstalder et al. | 175/404 |
| 4,228,862 | 10/1980 | Causse | 175/404 X |
| 4,345,484 | 8/1982 | Gould et al. | 73/864.44 X |

FOREIGN PATENT DOCUMENTS

| | | | |
|---|---|---|---|
| 1240063 | 7/1960 | France | 175/333 |

*Primary Examiner*—Hoang C. Dang
*Attorney, Agent, or Firm*—Roth & Goldman

[57] ABSTRACT

A device for extracting an undisturbed sample of soil to be tested from a subsurface location uses a cutter to remove unwanted soil from above the undisturbed sample. The device is particularly intended for extraction of soil from contaminated areas without loss of contaminants which are volatile at ambient temperatures. The device also is capable of chilling or freezing the sample in situ before extraction and testing. A method of using the device to take samples whenever volatile contaminants are sensed is also disclosed.

13 Claims, 5 Drawing Sheets

DEVICE FOR SAMPLING SOILS AND RETAINING VOLATILES THEREIN AND METHOD OF USING SAME

BACKGROUND OF THE INVENTION AND PRIOR ART

It is often necessary to obtain a sample of soil for the purpose of analyzing the composition and mechanical characteristics thereof or to determine the types and concentration of contaminants present in the soil. Volatile contaminants such as hydrocarbons present in the sample must be retained therein during removal of the sample from the ground so that an accurate determination of the concentrations of contaminants or pollutants present can be made. Prior known soil sampling techniques and devices are capable of removing an essentially undisturbed sample of soil from a subterranean location for the usual purpose of running compaction tests and the like in advance of a construction project or for characterizing contaminants in the soil. Such devices suffer from two disadvantages in that, first, they have no means for continuously removing soil from above the sampler as drilling progresses, and, secondly, known apparatus for taking samples is generally incapable of retaining volatile components in the sample during removal of the sample to the surface and while the sample is removed from the sampler at the surface.

It is known in the art from U.S. Pat. No. 2,779,195 Simon, to freeze a soil sample in situ so as to retain the water content thereof or to render a non-cohesive water containing sample cohesive.

SUMMARY OF THE INVENTION

The present invention accordingly provides a subterranean soil sampling device which cleanly penetrates the soil while continuously removing the undesirable portion of the soil above the sampling device and which removes an undisturbed soil sample with all contaminant fractions therein, including volatile components so that the sample can be analyzed at a surface test facility to provide an accurate indication of the types and concentration of contaminants present.

A method of using the sampler to obtain a sample when separate sensing means determines the presence of contaminants beyond an acceptable threshold value is also disclosed.

DESCRIPTION OF THE PREFERRED EMBODIMENT

Figure 1:
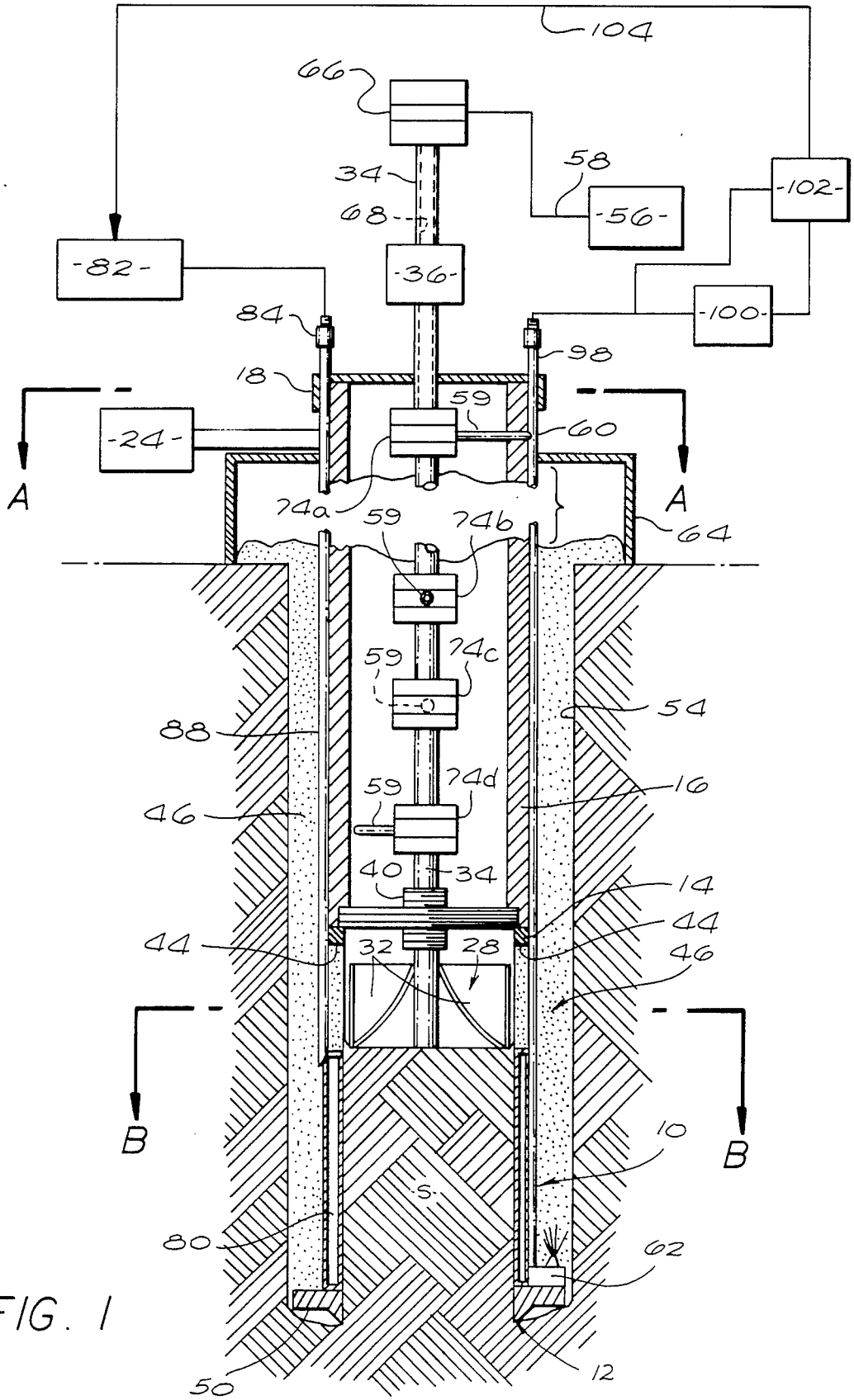
FIG. 1 is a schematic elevation view, partly in cross section, of the soil sampling device.

As seen in FIG. 1, the soil sampling device is comprised of a rotatable tubular sampler section 10 having a comprised of a rotatable tubular sampler section 10 having a sharpened lower cutting edge 12. The vertical length of the sampler section 10 is preferably selected such that the sample S to be tested will be sandwiched between cover layers of soil of sufficient thickness at both the top and bottom ends of the sampler section 10 so that the cover layers will effectively seal and prevent the sample S from loss of any volatile contaminants through exposed upper and lower surfaces. Removably affixed to the upper end of sampler section 10 is an adapter connector 14 which in turn is connected to casing sections 16. A casing cap 18 is provided to effectively pressure seal the interior of the casing. The casing sections 16, adapter connector 14 and sampler section 10 are rotatably driven together by a surface located casing drive motor 24 shown schematically. As will be appreciated by those familiar with the art, the device disclosed herein can be mounted on a standard drilling rig, not shown.

As seen also in FIG. 1, centrally disposed in the casing is a rotatable cutter 28 comprised of a rotatable blade 32 for removing soil from above the undisturbed sample S. Blade 32 is drivingly affixed to a vertically extending drive rod 34 which in turn is driven by a surface located cutter blade drive motor 36 shown schematically. A bearing support 40 is provided in the casing 16 at the adapter connector 14 above the cutter 28 to keep the cutter blade 32 centrally disposed in the casing. Cuttings produced by the rotating cutter blade 32 are discharged from the cutting surface radially outwardly from the cutter 28 through discharge ports 44 through the walls of casing 16 into an annulus 46 between the outer casing wall and the edge 54 of the borehole. This annulus 46 is created by an annulus cutter blade 50 rigidly affixed to the lower end of the sampler section 10 and rotatable therewith under the influence of the casing drive motor 24.

A source 56 of high pressure fluid, which may comprise hot or ambient temperature air or steam is preferably provided for the purpose of flushing the annulus 46 of cuttings created both by the annulus cutter 50 and by the central cutter blade 32. Hot air or steam may be chosen as desired by the operator if the presence of volatilizable contaminants is suspected or detected. For this purpose a conduit 58 is provided which extends downwardly from the source 56 of high pressure fluid to a discharge location having a plurality of circumferentially spaced upwardly directed discharge jets 62 located slightly above the upper surface of annulus cutter blade 50. Thus, high pressure fluid can be discharged continuously or periodically as desired by the operator to upwardly flush the cuttings and any volatile contaminant fractions present through the annulus 46.

Figure 2:
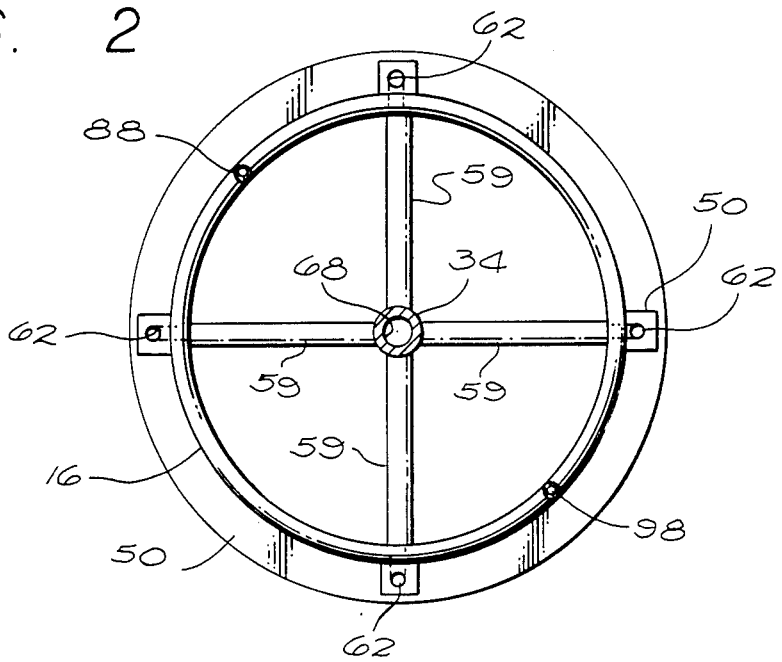
FIG. 2 is a horizontal cross section of the device of FIG. 1, taken at Line A—A therein.
Figure 3:
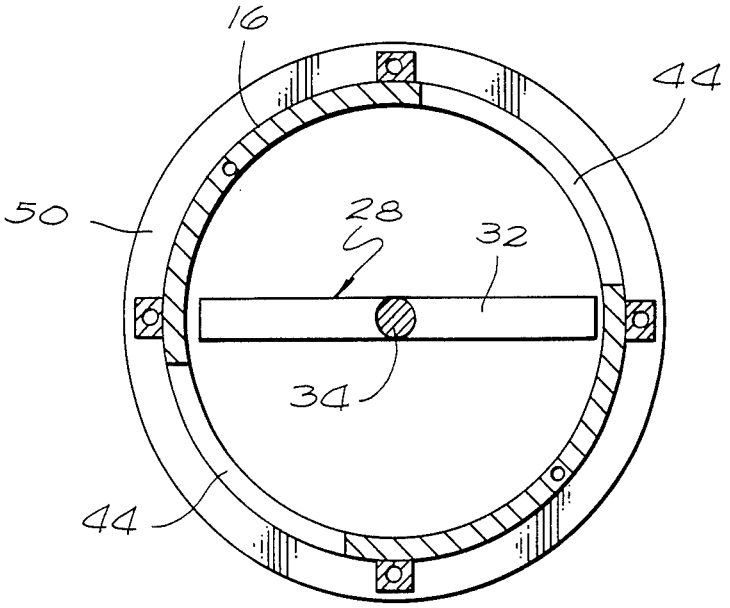
FIG. 3 is a horizontal cross section of the device of FIG. 1, taken at Line B—B therein.

As seen in FIGS. 2 and 3, the fluid supply conduit 58 extends from the fluid supply source 56 to a centrally located swivel connector 66 which is mounted on the cutter drive rod 34 above the cutter blade drive motor 36. High pressure fluid is thus permitted to enter a downwardly extending passageway 68 provided for this purpose in the cutter drive rod 34. This passageway 68 continues downwardly and is in fluid communication with a plurality of vertically spaced swivels **74*a*–74*d* mounted on the cutter drive rod 34** below the casing cap 18. A generally horizontally extending conduit 59 fixedly connected to casing 16 is provided in fluid communication with each of the swivels 74 for transmitting high pressure fluid generally radially from the cutter blade drive rod passageway 68 to vertically extending continuations 60 of the fluid conduit affixed to the casing 16 and movable therewith. These in turn are placed into fluid communication with the upwardly directed jets 62 above the annulus cutter 50.

Figure 4:
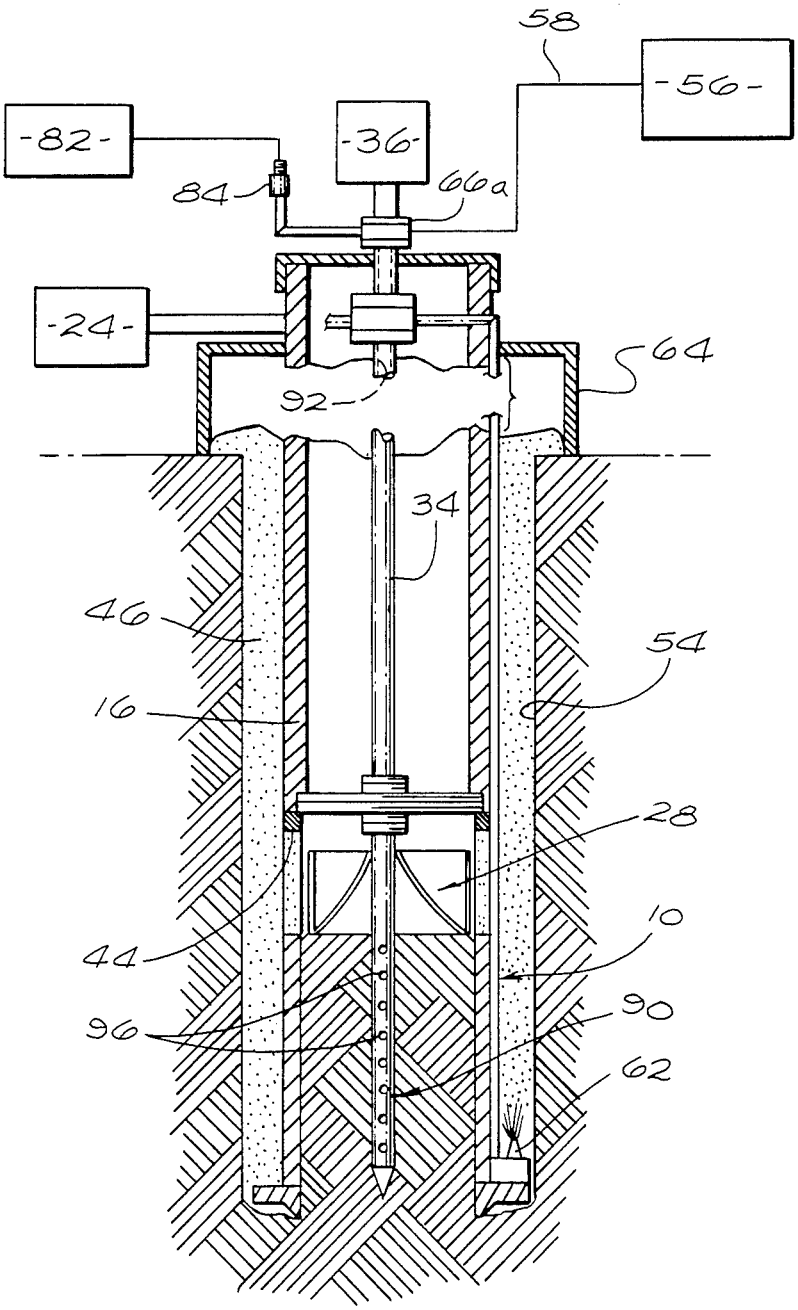
FIG. 4 is a schematic elevation view, like FIG. 1, but showing a modified form of sample cooling means used in the invention.
Figure 5:
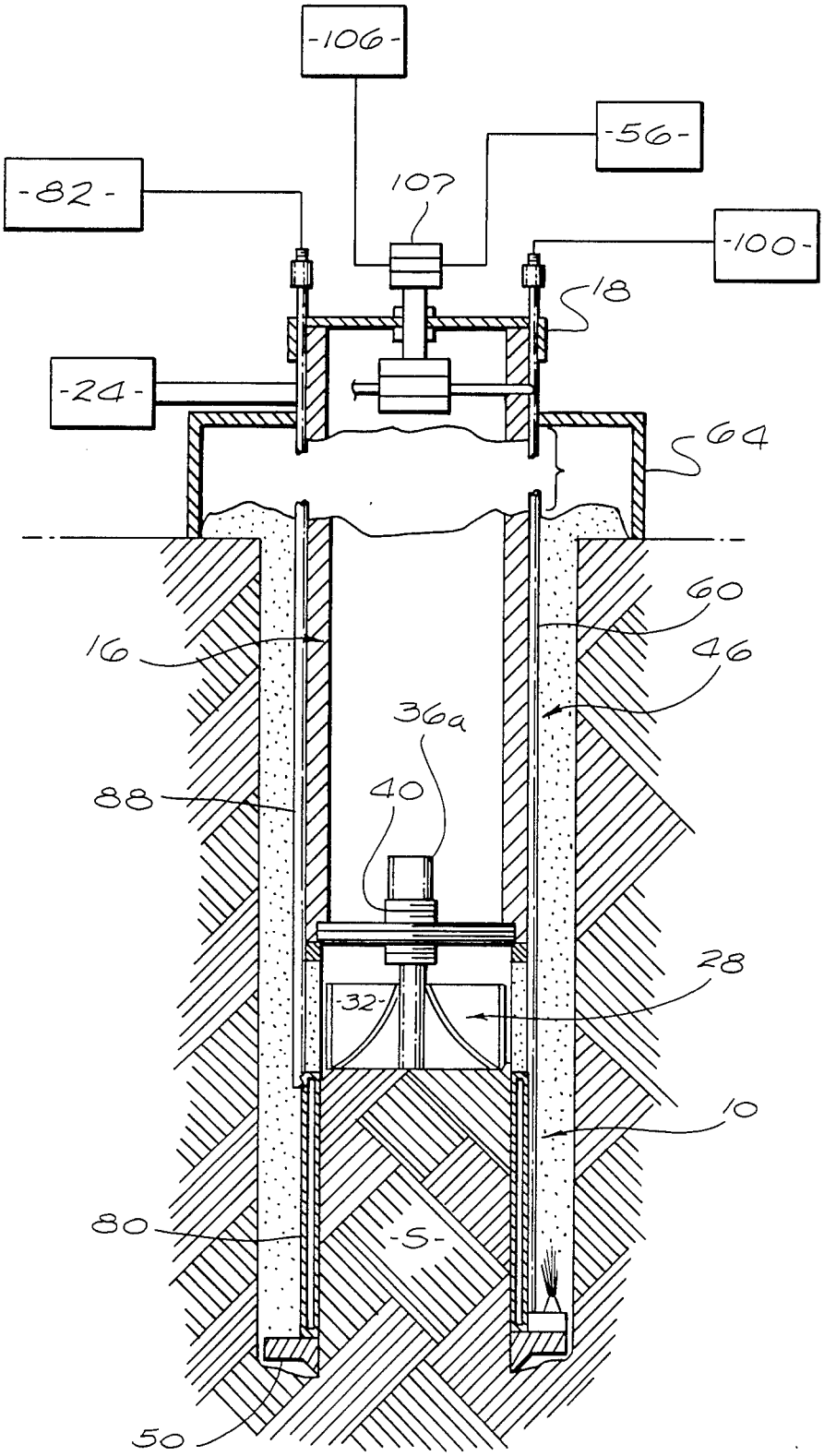
FIG. 5 is a schematic elevation view, like FIG. 1, but showing a downhole drive means instead of a surface located drive means.

As seen in FIGS. 1, 4 and 5, a gas containment hood 64 is provided at the ground surface in sealing engagement therewith and in sealing engagement with the outer wall of the casing so that volatile contaminants liberated from the downhole sampling and cutting are retained in the hood 64 and are thus prevented from escaping to atmosphere.

A particularly important feature of the invention comprises the provision of means for cryogenically cooling or freezing of the undisturbed soil sample S at the subsurface location so that volatile components in the sample S will not be lost during removal of the sample from the subsurface location nor lost during removal of the sample from the sampler section 10. Accordingly, as seen in FIG. 1, a thermally insulating jacket 80 is provided which substantially surrounds the exterior of the sampler section 10. A source 82 of cold fluid, preferably liquid nitrogen, is provided at the surface and is connected when desired via a quick disconnect coupling 84 to a downwardly extending coolant feed line 88 which extends in the annulus outside of the casing 16 and which at its lower end is attached to the thermally insulating jacket 80. Thus a continuous or intermittent supply of cooling fluid may be introduced into internal circulating passageways in the jacket 80 to rapidly chill and preferably freeze any water in the undisturbed sample S before removal of the sample to the surface and to prevent the escape of volatile components in the sample. An alternative form of jacket 80 may comprise a continuous spiral coil of coolant conduit extending around the periphery of the sampler section 10 and in heat transfer relationship therewith.

An alternative form of sample cooling means is shown in FIG. 4 which, instead of a jacket, comprises a centrally disposed pointed probe 90 intended to cool the soil sample S from the inside out rather than from the outside in. In this alternative form, which could also be used together with the jacket 80 shown in FIG. 1, the source 82 of cooling liquid is conducted downwardly through a vertically extending passageway 92 in the cutter blade drive rod 34 specially provided for this purpose. Expendable inert coolant liquid is then discharged through apertures 96 in the probe 90 to cool the sample S. A slightly modified swivel 66A, like swivel 66, can be used for connecting the air supply source to the passageway 92 in the drive rod and also for use as the connection to the liquid coolant source 82. A separate quick disconnect coupling 84 will then be provided for easily connecting or disconnecting the liquid coolant source 82 which is not in use during boring.

Spent liquid coolant or vapor from the jacket 80 may, if desired, be returned to the surface for recovery or analysis. There is accordingly provided a vertically extending coolant return line 98 as seen in FIG. 1, extending through casing cap 18 to a quick disconnect coupling. Spent fluid may be analyzed if desired in monitor 100 or is bypassed directly to a holding tank 102 which in turn is connected by a return line 104 to the source 82 of cold fluid. Spent vapors may be discharged to atmosphere provided that the coolant is non-toxic.

An alternative embodiment of the invention is shown in FIG. 5 and employs a pressurized casing 16 sealed by casing cap 18 and a cutter drive motor 36A located downhole in the pressurized casing 16. Since there is no cutter blade drive rod which extends to the surface as in the embodiment of the invention shown in FIGS. 1–3 and 4, means must be provided for supplying pressurized motive fluid to the downhole cutter drive motor 36A. For this purpose a second source 106 of high pressure air, typically at higher pressure than that which is required of the first source 56 used to flush the cuttings from the annulus 46, is provided at the surface and is placed in fluid communication with the interior of the casing 16 by a swivel 107 which extends through casing cup 18. The remaining components of the FIG. 5 embodiment are similar to those shown in FIG. 1 and like reference numerals have therefore been used to designate the same components. Use of a down hole cutter drive motor 36A may be preferred in some instances to the use of a long cutter drive rod extending from the surface to the downhole location at which the sample is to be taken.

Figure 6:
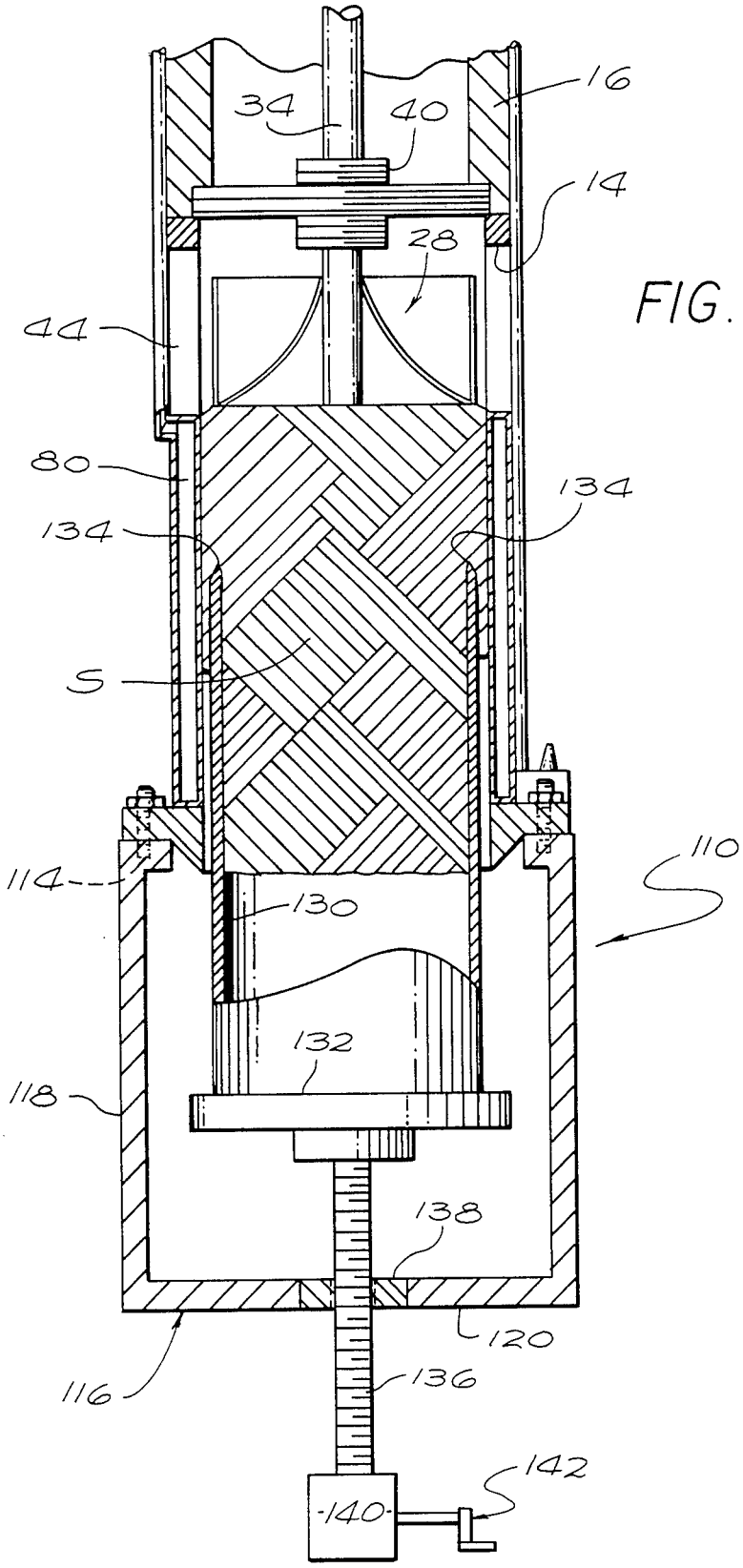
FIG. 6 is as schematic view, taken at the bottom of FIG. 1, showing a device for removing the soil sample from the sampler.

The sample remover 110 shown in FIG. 6 is attachable by fastening pins 114 or the like to the lower end of the casing 16 after it has been removed from the ground. The remover 110 comprises a frame 116 which may include a cylindrical wall section 118 and an annular base 120 integral therewith. An annular split sample cutter removal mold 130 having a flat supporting base 132 and a sharpened, preferably sawtooth leading edge 134 is centrally mounted for longitudinal movement in the frame 116. For this purpose a worm gear 136 centrally extending through a worm gear bearing 138 in the base 120 of the frame 116 is non-rotatably connected to the supporting base so that the removal mold 130 rotates about its longitudinal axis as the worm gear 136 rotates under power imparted thereto by a motor 140 or a hand crank 142 shown schematically.

In operation, the sampler section 10 and attached adapter and casing sections 14, 16 are rotatably driven into the soil to the desired depth of the sample S to be taken. Simultaneously with the insertion of the sampler, the centrally disposed cutter 28 is rotated and driven into the soil such that the cutter blade 32 continuously cuts and removes unwanted soil from immediately above the level of the sampler section 10. The cuttings are radially discharged through the discharge ports 44 and thence upwardly through the annulus 46 created by annulus cutter 50 to surface disposal. Fluid from the high pressure source 56 is used as necessary to assist in the removal of the cuttings.

Means (unshown) may be provided for sampling the gases collected in the containment hood 64 to determine the presence and concentration of preselected volatile contaminants therein. The sampled gases may then be scrubbed to remove contaminants to a safe level and the remaining cleansed gases discharged to atmosphere. It is particularly contemplated that the operator will use steam or heated air as the source of high pressure fluid to be emitted from the annulus cutter jets 62 whenever the presence of volatile contaminants is suspected or sensed in the collected gases in the containment hood 64 since heated fluid will liberate a greater proportion of the volatile contaminants which the operator wishes to detect than would be liberated by unheated fluid.

Whenever the sampling of gases from the containment hood 64 determines the presence of preselected contaminants beyond a safe threshold level, the operator may be signaled to take a soil sample in which the volatiles are retained and which then may be subjected to a more rigorous analysis at the surface with the results being compared with the results of the sensing 64. All of this collected data may then be correlated with vertical and horizontal position data and used to prepare detailed two or three dimensional mapping of the sampled area.

When the sampler has reached the desired depth, disconnect couplings 84 are attached to the coolant source 82 and the sample S is rapidly chilled by introducing cooling fluid to the jacket 80 and/or the central cooling probe 90. The centrally disposed cutter assembly is subsequently removed. Continuous circulation of cooling liquid is maintained during this time. Finally the casing sections 16 and attached adapter connector 14 and sampler section 10 with the undisturbed sample S therein are removed to the surface where the sample is quickly removed by the removal device 110 so that the sample may then be safely transported in a freeze box or the like to a laboratory for testing and without loss of volatile components.

Persons skilled in the art will readily appreciate that various modifications can be made from the preferred embodiment thus the scope of protection is intended to be defined only by the limitations of the appended claims.

I claim:

1. A soil sampling device comprising a tubular casing, a tubular hollow sampling section connected to a lower end of said casing for collecting an undisturbed sample of soil from a subsurface location, casing drive means connected to said casing above the sampling section for rotatably and longitudinally driving said casing and said sampling section into the soil to a desired subsurface location and forming an uncut generally cylindrical soil sample within the sampling section, cutter means arranged in said casing above the uncut sample to be taken for continuously cutting soil from the upper surface of said sample as said casing and sampling section are driven into the soil, an annulus cutter blade on the lower end of said sampling section and rotatable therewith to cut an annulus, and means provided on the exterior of said casing above said annulus cutter blade for injecting a stream of pressurized flushing fluid above said blade into said annulus in a direction having an upward component for removing the unwanted soil cut from the top of said sample from said annulus.

2. The soil sampling device of claim 1, further comprising soil discharge apparatus in said casing disposed adjacent said cutter means, said cutter means having a blade mounted within the casing for rotation relative to the casing and sampler section and radially discharging cut soil through said apertures in said casing into said annulus formed between the casing and a wall of a borehole formed by the casing and sampler section.

3. The soil sampling device of claim 1, further comprising means provided on the sampling section for cooling said sample of soil in situ and for maintaining the temperature of said sample below ambient temperature during removal of the sample from said subsurface location.

4. The soil sampling device of claim 3, wherein said means for cooling said sample of soil comprises a heat exchanger forming a thermal insulating jacket arranged surrounding said sampling section and means associated with the jacket for cooling said jacket.

5. The soil sampling device of claim 4, wherein said means for cooling said jacket comprises a source of cooling fluid and conduit means connected to the jacket for supplying cooling fluid from said source to said jacket.

6. The soil sampling device of claim 1, wherein said sampling section has a sharpened cutting edge disposed below a lower end thereof for facilitating insertion of the casing and sampler section into soil to be sampled, and said annulus cutter blade is affixed to said sampling section above said cutting edge.

7. The soil sampling device of claim 5, wherein said means for cooling said sample of soil are disposed exteriorly of said sampling section in the annulus above said annulus cutter blade.

8. The soil sampling device of claim 1, wherein said means for injecting comprises a source of high pressure flushing fluid, a plurality of fluid discharge nozzles and conduit means connected to the source for conducting said fluid from said source to said discharge nozzles.

9. A method of sampling of soil to determine the location, identity and concentration of contaminants therein comprising the steps of:

(a) inserting a tubular casing into the soil, said casing having a sampler section affixed thereto for collecting a sample of soil from an underground location;

(b) cutting an annulus in the soil outside of said sampler section during insertion of said casing into the soil;

(c) injecting pressurized fluid into said annulus near the lower end thereof;

(d) cutting soil and removing same from above said sampler section through said annulus during insertion of said casing into the soil;

(e) collecting said pressurized fluid and any volatile fractions liberated from the soil by said cutting and injection and preventing the escape thereof to atmosphere;

(f) analyzing said volatile fractions to determine the identity and concentration of selected contaminants therein;

(g) collecting a sample of soil in said sampler section when the analysis of said volatile fractions indicates that a predetermined threshold concentration of said contaminants has been exceeded, said sample being collected in a manner in which volatiles present in said sample are retained therein during removal of said sampler section to the surface and during removal of the sample from the sampler section;

(h) analyzing said sample to determine the identity and concentration of said selected contaminants therein; and (i) comparing the results of the analysis of said volatile fractions with the analysis of said sample to obtain therefrom an accurate profile of the variance of concentrations of said contaminants with distance from a reference datum.

10. The method of claim 9, wherein said pressurized fluid is heated.

11. The method of claim 9, wherein said sample is frozen in situ before being removed.

12. The method of claim 9, wherein three dimensional coordinates of the location at which each sample is taken are measured from said reference datum.

13. The method of claim 12, wherein said three dimensional coordinates are correlated with data representative of the identity and concentration of said contaminants to prepare a map.

* * * * *